US010449112B2

(12) United States Patent
Godfrey et al.

(10) Patent No.: US 10,449,112 B2
(45) Date of Patent: Oct. 22, 2019

(54) VIBRATING MASSAGE ROLLER

(71) Applicant: Health e Vibrations, LLC, Salt Lake City, UT (US)

(72) Inventors: Brian P. Godfrey, Salt Lake City, UT (US); Vince Warner, Salt Lake City, UT (US)

(73) Assignee: Healtch e Vibrations, LLC, Salt Lake City, UT (US)

( * ) Notice: Subject to any disclaimer, the term of this patent is extended or adjusted under 35 U.S.C. 154(b) by 560 days.

(21) Appl. No.: 14/958,550

(22) Filed: Dec. 3, 2015

(65) Prior Publication Data

US 2016/0158096 A1 Jun. 9, 2016

Related U.S. Application Data

(60) Provisional application No. 62/087,227, filed on Dec. 3, 2014.

(51) Int. Cl.
*A61H 15/00* (2006.01)
*A61H 23/02* (2006.01)

(52) U.S. Cl.
CPC ..... *A61H 23/0263* (2013.01); *A61H 15/0092* (2013.01); *A61H 2015/0014* (2013.01); *A61H 2015/0071* (2013.01); *A61H 2023/0281* (2013.01); *A61H 2201/5043* (2013.01)

(58) Field of Classification Search
CPC ..... A61H 23/0263; A61H 15/0092; A61H 2023/0281; A61H 2201/5043; A61H 2015/0014
See application file for complete search history.

(56) References Cited

U.S. PATENT DOCUMENTS 1,723,268 A 8/1929 Conill
1,936,022 A 11/1933 Hunt
2,213,482 A 9/1940 Avery
(Continued)

FOREIGN PATENT DOCUMENTS

CN 101671864 3/2010
NO 2004067364 8/2004

OTHER PUBLICATIONS

Katz, Anthony "Hyperice-Kickstarter", 2 pages; © 2015; https://www.kickstarter.com/profile/74007868; website Hyperice.com;.
(Continued)

*Primary Examiner* — Timothy A Stanis
(74) *Attorney, Agent, or Firm* — Avery N. Goldstein; Blue Filament Law PLLC

(57) ABSTRACT

A vibratory massage roller is provided for therapeutic massage, intimate massage, physical therapy, yoga, physical conditioning, and general well-being. The massage roller and method for balancing the massage roller, increasing the overall utility and therapeutic value so as to more efficiently massage a subject through resort to a vibrational roller having a tubular casing containing a motor housed in the center of the tubular casing, a central axle projecting from the motor, a plurality of eccentric propellers, positioned at different points along the central axle, the tubular casing vibrationally linked to the axle by the plurality of eccentric propellers via a plurality of housing supports and an optional surface casing extending over a length of the vibratory roller.

14 Claims, 3 Drawing Sheets

(56) References Cited

U.S. PATENT DOCUMENTS

| | | | | |
|---|---|---|---|---|
| 2,425,655 | A | 8/1947 | Tompkins | |
| 2,441,394 | A | 5/1948 | Bucy | |
| 2,466,470 | A | 4/1949 | Norris | |
| 2,523,547 | A | 9/1950 | Zerkle | |
| 2,539,712 | A | 1/1951 | Wettlaufer | |
| 2,604,091 | A | 7/1952 | Hansen | |
| 2,675,800 | A | 4/1954 | Voorhees | |
| 2,786,465 | A | 3/1957 | Moxley | |
| 2,821,191 | A | 1/1958 | Paii | |
| 2,904,036 | A | 9/1959 | Thomas | |
| 2,924,216 | A | 2/1960 | Stewart | |
| 2,943,621 | A | 7/1960 | Phillips et al. | |
| 3,064,642 | A | 11/1962 | Stewart | |
| 3,092,099 | A | 6/1963 | Berard | |
| 3,322,116 | A | 5/1967 | Murphy et al. | |
| 3,363,623 | A | 1/1968 | Atwell | |
| 3,381,538 | A | 5/1968 | Runde | |
| 3,464,405 | A | 9/1969 | Kallus | |
| 3,547,109 | A * | 12/1970 | Miles | 601/65 |
| 3,580,245 | A | 5/1971 | Dill | |
| 3,580,246 | A | 5/1971 | Foreman | |
| 3,831,591 | A | 8/1974 | Newkirk | |
| 3,896,795 | A | 7/1975 | Solhkhah | |
| 3,981,032 | A | 9/1976 | Brooks | |
| 3,996,929 | A | 12/1976 | Mabuchi | |
| 4,005,703 | A | 2/1977 | Rosen | |
| 4,081,870 | A | 4/1978 | Iannucci | |
| 4,198,962 | A | 4/1980 | McCauley | |
| 4,347,838 | A | 9/1982 | McCauley | |
| 4,559,929 | A | 12/1985 | Hseu | |
| 4,722,326 | A | 2/1988 | Ruderian | |
| 4,878,489 | A | 11/1989 | Kamayachi | |
| 4,947,832 | A | 8/1990 | Blitzer | |
| 5,007,410 | A | 4/1991 | Delaney | |
| 5,330,416 | A | 7/1994 | Masuda et al. | |
| 5,374,238 | A | 12/1994 | Xiao | |
| 5,393,287 | A | 2/1995 | Papapaschalis | |
| 5,393,297 | A | 2/1995 | Kristoff | |
| 5,437,607 | A | 8/1995 | Taylor | |
| 5,471,103 | A | 11/1995 | Fujii | |
| 5,545,125 | A | 8/1996 | Tseng | |
| 5,554,102 | A | 9/1996 | Chiou | |
| 5,824,013 | A | 10/1998 | Allen | |
| 5,830,161 | A | 11/1998 | Cosmano | |
| 5,833,635 | A | 11/1998 | Aboud, Sr. | |
| 5,902,256 | A | 5/1999 | Benaron | |
| 6,039,702 | A | 3/2000 | Cutler et al. | |
| 6,056,357 | A | 5/2000 | Fukuoka | |
| 6,203,470 | B1 | 3/2001 | Lundin et al. | |
| 6,309,331 | B1 | 10/2001 | Raymond | |
| 6,468,236 | B1 | 10/2002 | Sumanac | |
| 6,505,361 | B1 | 1/2003 | Hayashibara | |
| 6,505,661 | B1 | 1/2003 | Ogawa | |
| 6,647,572 | B2 | 11/2003 | Lee | |
| 6,702,766 | B2 | 3/2004 | Guitay | |
| 7,087,004 | B1 | 8/2006 | Berke | |
| 7,297,126 | B2 | 11/2007 | Grose | |
| 8,500,663 | B2 | 8/2013 | Godfrey et al. | |
| 8,556,837 | B1 | 10/2013 | Poirier | |
| D714,952 | S | 10/2014 | Gonglach et al. | |
| 9,968,513 | B1 | 5/2018 | Marton et al. | |
| 2003/0131414 | A1 | 7/2003 | Lee | |
| 2003/0131416 | A1 | 7/2003 | Lee | |
| 2004/0267173 | A1 | 12/2004 | Mangano | |
| 2005/0033203 | A1 | 2/2005 | Son | |
| 2005/0070827 | A1 | 3/2005 | Lee | |
| 2006/0270954 | A1 | 11/2006 | Tumey | |
| 2007/0129654 | A1 | 6/2007 | Anderson, Jr. | |
| 2008/0070210 | A1 * | 3/2008 | Hitzmann | A61H 15/00 434/237 |
| 2008/0200851 | A1 | 8/2008 | Faussett | |
| 2008/0214969 | A1 | 9/2008 | Milne et al. | |
| 2009/0176635 | A1 | 7/2009 | Brinson | |
| 2010/0113992 | A1 | 5/2010 | Godfrey et al. | |
| 2010/0274162 | A1 | 10/2010 | Evans | |
| 2012/0310125 | A1 * | 12/2012 | Hall | A61H 15/0085 601/120 |
| 2013/0281892 | A1 * | 10/2013 | Godfrey | A61H 15/0078 601/15 |

OTHER PUBLICATIONS

Gonglach, Mark "RollingFWD High-Tech Vibrating Foam Roller" Nov. 20, 2015; 6 pp.; https://www.kickstarter.com/projects/951900514/rollingfwd-high-tech-vibrating-foam-roller.

* cited by examiner

VIBRATING MASSAGE ROLLER

CROSS REFERENCE TO RELATED APPLICATIONS

This application claims priority benefit of U.S. Provisional Application Ser. No. 62/087,227 filed 3 Dec. 2014; the contents of which are hereby incorporated by reference.

FIELD OF THE INVENTION

The present invention relates to the field of massagers and more particularly relates to a massage roller that affords a level of uniformity of vibration to a subject along the length of the roller.

BACKGROUND OF THE INVENTION

Massage is the manipulation of subject muscles and soft tissues in order to affect a release of tension. Massage involves many strategies, including kneading and stretching muscles, percussive striking, and vibration. Massage is well known in the fields of medicine, chiropractic, physical therapy, kinesiotherapy and fitness. Massage is practiced universally around the globe, both professionally and personally, and is recognized as providing some benefits to the mental, emotional and physical health of those receiving it.

In light of the almost universal appeal and recognition of massage, many different styles of massage have been developed, ranging from Shiatsu, Swedish, Deep Tissue, and others, and tools to aid in massage have developed in each discipline. One such tool is known as a massage roller or foam roller. Foam rollers are cylindrical or semi-cylindrical bodies made of a compliant material, such as foam, which are used for massaging and stretching soft tissues, increasing circulation, reducing pain, tension and stress from the soft tissues, improving posture and alignment, increase spinal mobility. Core and corrective exercises can be used with the roller as well.

Prior art solutions that use eccentric weights rotating about an axle fail to evenly distribute vibrations to a roller or other massager surface as they generally have only two contact points, one at the motor and one at or by a terminal end of the axle. This localizes all vibrational transmission at those two end points and can cause "weak spots" or "dead zones" along the length of a massager apparatus, especially if they are improperly spaced and allow destructive interference between the two points of contact. This spatial disparity in vibrational amplitude is a result of construction method with a motor and an eccentric weight mounted to a shaft extending from the motor to define a cylindrical axis. Stronger vibrations are created proximal to the weight with the vibrational amplitude decaying as a functional of lateral distance from the eccentric weight. As a result, when the weight is at one end of the roller, vibrations will dissipate inward from the weighted end along the length of the roller, whereas, a centrally located weight has vibrations that will still dissipate towards the ends. This vibrational amplitude decay is especially noticeable in longer rollers.

The use of several motors along a roller coupled to eccentric weights to alleviate these problems has met with limited success and also creates harmonic vibrating waves that tend to create points of low amplitude strength vibrations at certain positions along the roller with the position in part dictated by the rotational rate. Exemplary of these efforts is U.S. Pat. No. 6,647,572 in which vibratory nodes are partially mitigated and may be more evenly distributed, yet the reliance on several motors increases cost, weight, and device proclivity to breakage. The problems posed by motor failure are enhanced by the fact that the motor is generally inaccessible for repair and effectively encased in a surrounding roller material. Still another attempt to address the problem of vibrational amplitude inhomogeneity along the length of the roller involves mounting multiple eccentric weights along a single rotating shaft; however, this tends to either accentuate the inhomogeneity if the weights are radially aligned or if radially distributed around the shaft, torque is imparted to the motor that leads to motor damage. Moreover, mounting multiple eccentric weights along a single rotating shaft tends to cause increased imbalance of the roller, further exacerbating the problem of vibrational amplitude inhomogeneity and decreasing the overall therapeutic utility of the massage roller. A conventional method to compensate for wobble induced by eccentric weight rotation around a shaft has been to place housing contacting supports proximal to the shaft and rotating weight. The support also serves to transmit vibratory forces to the surface of the massager. Unfortunately, reliance on supports increases the complexity of forming the housing and also decreases the operational efficiency of the resultant massager.

Thus, there exists a need for a vibrating massage roller that provides a degree of positional uniformity in vibration along the roller imparted to a subject in contact with the roller with a simplified construction and operational efficiency to maximize the overall therapeutic utility to a subject in contact with the roller.

SUMMARY OF THE INVENTION

A massage roller is provided includes that a motor. A first axle projects from the motor. Propellers, each having an eccentric weight are positioned at different points along the first axle. A tubular casing with housing supports contains the motor and is vibrationally linked to the first axle by the propellers via the housing supports; and also contains the power supply for the motor. The massage roller further includes a second axle extending from the motor in opposition to the first axle; and a second plurality of eccentric propellers, positioned at different points along the second axle.

A massage roller is also provided includes that a motor. A first axle projects from the motor. Eccentric weights are positioned at different points along the first axle. A tubular casing having a length contains the motor and is vibrationally linked to the first axle by the eccentric weights. A battery pack is electrically coupled to the motor having the batteries split along the length of the tubular casing.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DESCRIPTION OF THE PREFERRED EMBODIMENTS

Figure 1A:
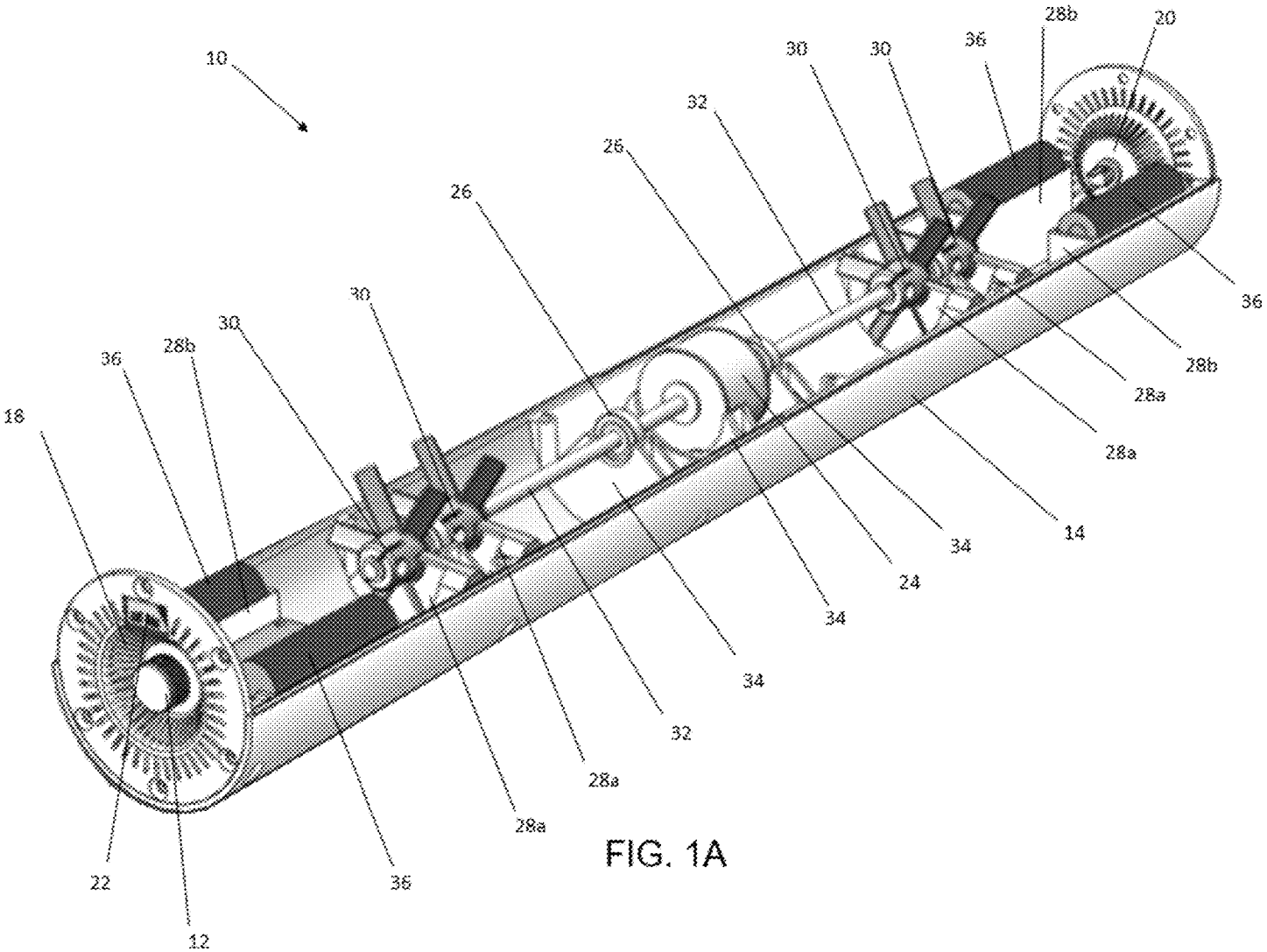
FIG. 1A is a perspective view of the massage roller according to one embodiment of the invention.

The present invention has utility as a vibratory massage roller. Representative applications of the present invention include therapeutic massage, intimate massage, physical therapy, yoga, physical conditioning, and general well-being.

In view of the foregoing disadvantages inherent in the known types of massagers, this invention provides a massage roller and method for balancing a massage roller, thus increasing the overall utility and therapeutic value so as to more efficiently massage a subject through resort to a vibrational roller having a tubular casing containing a motor housed in the center of the tubular casing, a central axle projecting from the motor, a plurality of eccentric propellers, positioned at different points along the central axle, the tubular casing vibrationally linked to the axle by the plurality of eccentric propellers via a plurality of housing supports and an optional surface casing extending over a length of the vibratory roller. In other inventive embodiments, the vibratory amplitude to the surface that varies less than 30 amplitude percent across the central 70 percent of the length of the roller. In some inventive embodiments, the vibratory amplitude is controlled to between 5 and 25 amplitude percent across the central 70 percent of the length of the roller at operational speeds for subject massage. In still other inventive embodiments, the vibratory amplitude is controlled to within 10 amplitude percent across the central 70 percent of the length of the roller at operational speeds for subject massage.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

With reference now to the drawing, the preferred embodiment of the vibrational roller is herein described. It should be noted that the articles "a", "an", and "the", as used in this specification, include plural referents unless the content clearly dictates otherwise.

The present invention represents a departure from the prior art in that the process of massage is enhanced by contacting an energized vibratory massaging roller of the present invention with a subject that allows for more even distribution of vibrations and allows for a more balanced distribution of the weight of the internal components of the energized vibratory massaging roller thereby increasing the therapeutic utility of the roller when in use and in contact with a subject. In certain embodiments, this is accomplished by utilizing a plurality of eccentric propellers and housing supports that are positioned at various identical points along the longitudinal axes of each half of identical tubular casing components that fit together to form one cohesive tubular casing around the internal components of the roller, parallel to the axis of the cylinder, and are synchronized and positioned for maximum vibrational efficiency and optimum balance. By utilizing a plurality of strategically placed eccentric propellers and strategically placed housing supports, the vibrations engage in reinforcing behavior as they travel the length of the roller, which keeps vibrations uniform throughout the roller, even in a longer roller. By using one motor and one axle, there are fewer parts and less chance of malfunction and easier to replace or fix when malfunction does occur. In certain embodiments, this is accomplished by utilizing two identical halves of tubular casing that join together along the longitudinal axis of the roller thus allowing for easy removal of the top half of identical tubular casing and easy access to the internal components of the roller when such replacements or fixes become necessary when malfunction does occur. Roller length typically is from 12 to 36 inches and circumference may vary from 3 to 10 inches. The roller should be able to resist up to 350 pounds of pressure.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

An embodiment of an inventive roller is shown generally in the figures at 10. The roller 10 has two identical tubular casing portions 14 and 16 that define a hollow center. It is appreciated that the casing portions 14 and 16 as shown are symmetric and define casing halves; While the tubular casing is depicted herein as a right cylinder, it is appreciated that other cross-sectional shapes are operative herein that include oval, triangular, square, pentagonal, hexagonal and higher polygonal shapes. Resident inside the center, is a shaft (synonymously referred to herein as a first axle) 32 mounted between a thrust bearing 26 and a motor 24. A coupling may be used to couple the shaft 32 to the motor 24, or the shaft 32 may connect directly to the motor 24 as shown in the figures. Supports 34 are provided to provide a vibration communication between the casing portions 14 and 16 and the shaft 32. Bearings 26 provide a rolling surface, and thus reduced friction, to the shaft 32. A plurality of eccentric propellers 30 are positioned along the shaft 32. These propellers 30 are each a different length from the motor 24, or from a chosen reference point that is on the shaft 32. The motor 24 is supported by a motor support 34. A propeller 30 has at least two blades. The blades have a blade pitch relative to the direction of rotation of between 0 and 70 degrees in some embodiments. An eccentric weight is either integral with a blade, several of the blades or is a separate piece that is attached to one or more blades of the propeller 30 to induce vibration. In certain inventive embodiments, the eccentric weight has a curved distal surface that follows the contour of an inner surface of the tubular casing portions 14 and 16. The blades of the propeller 30 have lengths that are the same in some embodiments and in other embodiments, the blades vary less than 10 percent from the average blade length. The eccentric blades mean that the center of mass is not positioned on the shaft 32 itself, but rather radially displaced some distance, x, away from the axis of rotation of the shaft 32. Thus, when the shaft 32 rotates along its axis, the propellers 30 circumscribe a circular motion about the axis and impart a wobble to the shaft 32. This wobble is transmitted to the tubular casing portions 14 and 16 through the housing supports 28*a*. When a sufficient rotational speed measured for example in revolutions per minute (RPM) are reached, the wobble causes a strong vibration transmitted throughout the casing portions 14 and 16. The propellers 30 and housing supports 28*a* are strategically positioned about the shaft 32 so as to provide maximum synchronous and uniform vibration advantage during rotation, which is to say they are positioned in a manner to provide a uniform vibrational profile throughout the shaft 32 and entire roller 10. The positioning of the propellers 30 and housing supports 28*a* is of paramount importance as these structures actually impart the uniform vibrational profile to the surface of the roller and also provide for optimal balance of the roller itself. The battery pack in certain inventive embodiments is split and divided so as to be composed of discrete batteries 36 that are housed at each end of the vibratory roller to promote weight balance and therapeutic utility to the vibratory roller. The battery 36 is sized to fit into a battery support 28*b*. In some embodiments, an even number of batteries 36 are present. An even number of batteries facilitates splitting into two groups of batteries that are positioned on opposite ends of the casing 14 and 16 and afford a weight balancing to the massage roller 10. It is also appreciated that a single group of batteries positioned about the center of gravity of the massage roller 10 with a central motor having opposing shafts extending therefrom. The batteries in a specific embodiment defining a perimeter around the motor. An exemplary roller with opposing shafts is detailed in U.S. Pat. No. 8,500,663 B2 with respect to FIG. 6.

Figure 1B:
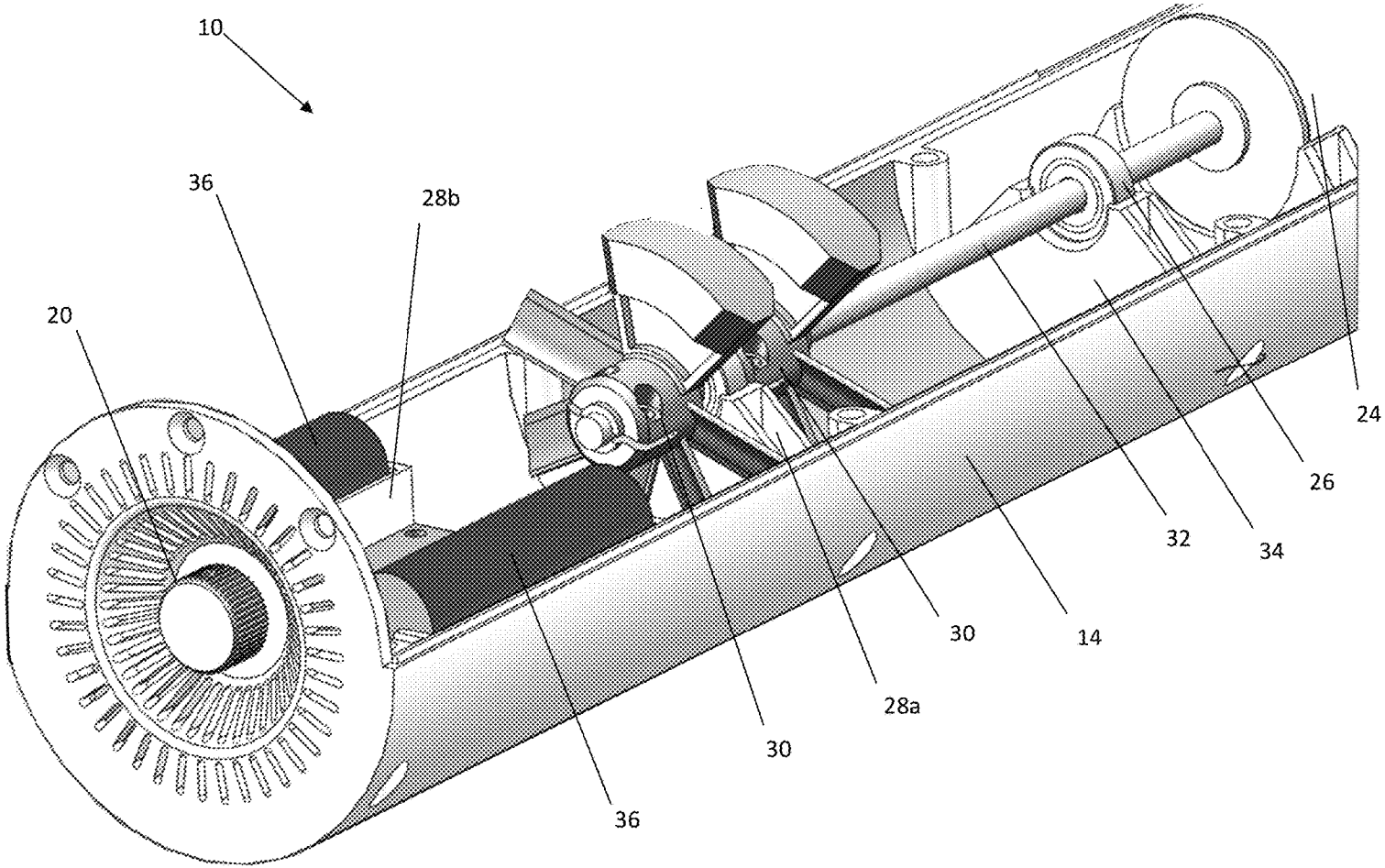
FIG. 1B is a magnified view of the distal portion of the massage roller shown in FIG. 1A.
Figure 2:
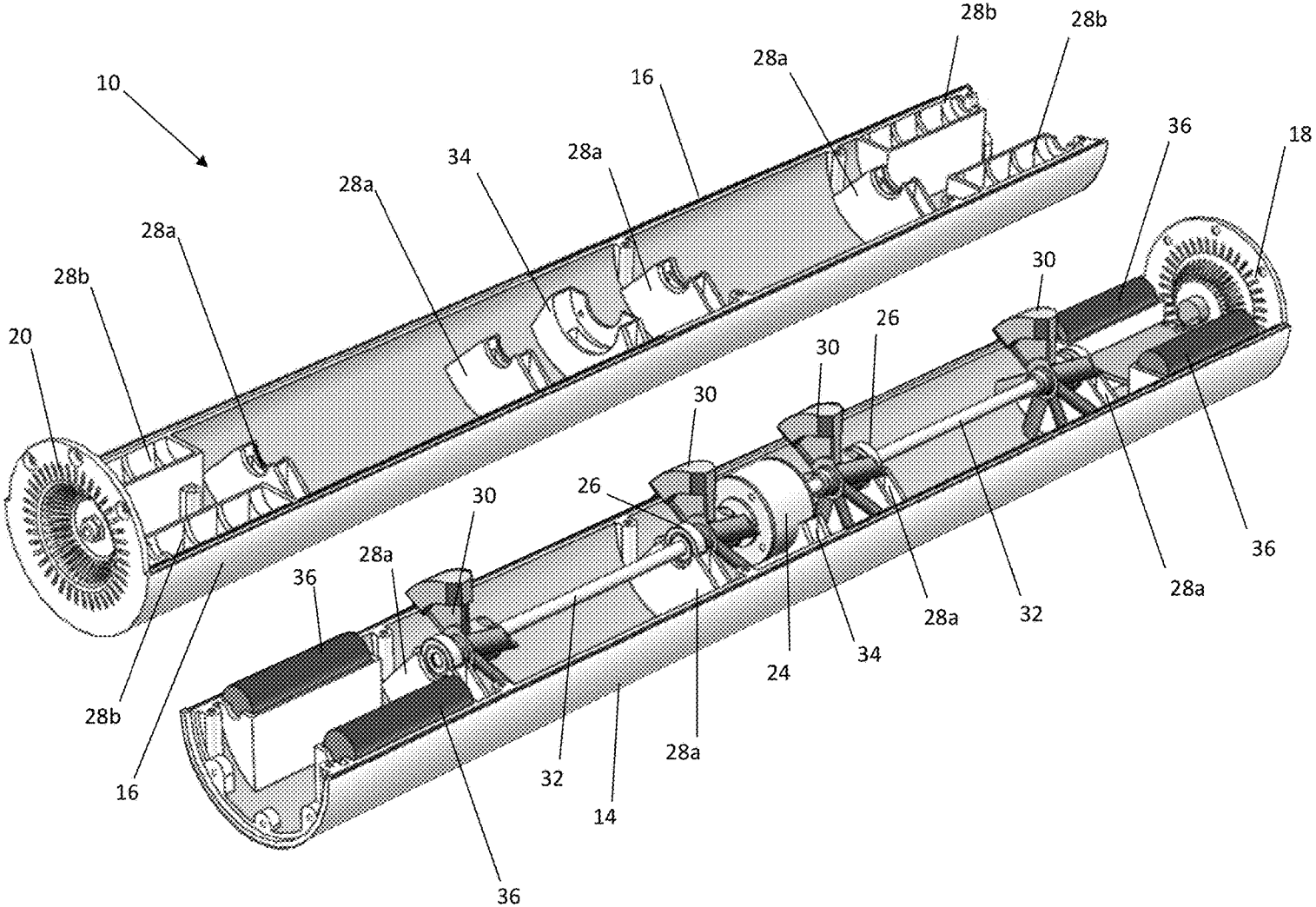
FIG. 2 is a perspective view of the massage roller shown in FIG. 1A including the complementary second housing portion.

Through proper positioning of these propellers and housing supports, vibrations at the surface of the roller will have uniform strength along the length of the roller, with no "dead" or "weak" spots where vibration is not present due to destructive wave interference. The roller will also be optimally balanced providing efficient ease of use by a subject thereby increasing the overall therapeutic utility of the roller when used by a subject. The housing supports 28*a* and the propellers 30 are shown in FIGS. 1A, 1B, and 2 with each propeller 30 being distal to an adjacent housing support 28*a*; however, it is appreciated that the relative spacing between a housing support 28*a* and the distal propeller 30 and indeed, the mass and radial displacement of a given propeller are amenable to adjustment to achieve a vibratory amplitude to the surface that varies less than 30 amplitude percent across the central 70 percent of the length of the roller.

Control of the motor 24, and thus the vibration, is achieved through control unit 12, which may be a separate unit or positioned on the forward end cap 18 (as shown), which seals one end of the roller 10. The other end is sealed by a second end cap 20. Control unit 12 may have different switches to alter the vibrational characteristics by adjusting the rotational characteristics of the motor 24. Such alterations are principally through control of motor rotational speed to set up higher harmonics of vibration that modify the frequency and amplitude of the vibration imparted to a subject in contact with an inventive roller surface. Communication of changes may be displayed on an LCD screen 22 or through indicia as to setting of for example "off", "low" and "high".

It is appreciated that a single embodiment readily incorporates supports 28*a* of varying widths, and energy transmissive properties. In another inventive embodiment, the other axle, each of different length, extending from the same motor and having one or more eccentric propellers mounted thereon. Ideally these would be along the same axis and then could even be a single axle passing through the motor 24. In certain inventive embodiments that have opposing first and second axles, the roller 10 is weight balanced within 20 percent from the geometric center of the roller 10. Separate axles may be used which have different axes, and positioning them and weights about them for maximum effect, namely the even distribution of vibrations to the surface of the roller, would be a mathematical calculation that could be ascertained with not much difficulty and would involve the length and mass of the axle and roller as whole, moment of inertia of the axle and weights, rotational frequency and other factors.

The casing portions 14 and 16 are readily formed from a variety of thermoplastic, and metal materials. These materials illustratively include polyvinyl chloride, acrylonitrile butadiene styrene, acetal homo- and co-polymers, polyamides, polyacrylates, polyacrylics, polycarbonate, polyethylene, polypropylene, polystyrene, polyurethane; aluminum, steel, powder metal, or combinations thereof.

In use, about the tubular casing portions 14 and 16 has an exterior sleeve (not shown) made of a durable, yet deformable material, such as foam rubber or cloth so as to impart a pleasing surface which will efficiently and effectively transmit vibrations and to provide impact resistance, sound dampening, and electromagnetic insulation. As used herein, the term "exterior sleeve" is intended to encompass conventional layers overlaid onto the casing that are either permanent or replaceable overlayers. It is appreciated that multiple such sleeves, each of like or varying material is used simultaneously. An effective layer of such material should be between 0.25 and 3 inches thick, depending upon the size of the roller and internal vibrational motor. The tube may be inserted in padded sleeves of varying textures, density and softness for desired effect on vibration or sensation. Sleeve thickness will be between 1 and 3 inches, depending upon desired effect and materials. This will then impart 2 to 6 inches to the diameter of the roller. The use of sleeves is preferable as the sleeves may be made to be washable, an important feature in clinical use, and can provide protection of the roller unit from elements and wear and tear. Individual sleeves may also be provided for varying textures, support, and firmness and also can be used to provide thermal variation for therapeutic use. It is appreciated that the firmer the rubber sleeve, the more deep tissue massage. It is also appreciated that the sleeve is readily wrapped around the casing and attached thereto through hook and loop fasteners, snapping fittings, a zipper or a pressure fit.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

Although the present invention has been described with reference to preferred embodiments, numerous modifications and variations can be made and still the result will come within the scope of the invention. No limitation with respect to the specific embodiments disclosed herein is intended or should be inferred.

The invention claimed is:

1. A massage roller comprising:

a motor;

a first axle projecting from said motor;

a first plurality of eccentric weights, said first plurality of eccentric weights positioned at different points along said first axle;

a thermoplastic or metal tubular casing having a length defined from a first end of said thermoplastic or metal tubular casing and a second end of said thermoplastic or metal tubular casing, said thermoplastic or metal tubular casing having a central longitudinal axis, said thermoplastic or metal tubular casing having a center located equidistant from the first end and the second end, said motor being contained within said thermoplastic or metal tubular casing at the center of said thermoplastic or metal tubular casing, and said thermoplastic or metal tubular casing being vibrationally linked to said first axle by said first plurality of eccentric weights; and a battery pack positioned inside said thermoplastic or metal tubular casing and electrically coupled to power said motor, said battery pack having a plurality of batteries split along the length of said thermoplastic or metal tubular casing and at least one of said plurality of batteries displaced from the central longitudinal axis of said thermoplastic or metal tubular casing;

wherein said massage roller is axially weight balanced at the center of said thermoplastic or metal tubular casing.

2. The massage roller of claim 1 wherein said battery pack includes an even number of batteries.

3. The massage roller of claim 2 wherein said battery pack has two groups.

4. The massage roller of claim 1 wherein said first plurality of eccentric weights are each mounted to at least one blade of a propeller.

5. The massage roller of 4 wherein said propeller has at least two blades.

6. The massage roller of claim 5 wherein the at least two blades have a blade pitch of between 0 and 70 degrees.

7. The massage roller of claim 1 further comprising a second axle extending from said motor in opposition to said first axle and a second plurality of eccentric weights positioned at different points along said second axle.

8. The massage roller of claim 7 wherein said first axle and said first plurality of eccentric weights are weight balanced relative to said second axle and said second plurality of eccentric weights.

9. The massage roller of claim 1 wherein said thermoplastic or metal tubular casing consists of two identical halves.

10. The massage roller of claim 1 further comprising a display screen for displaying a vibrational amplitude output, said display screen located on an end cap positioned at one of the first end or second end of said thermoplastic or metal tubular casing.

11. The massage roller of claim 1 wherein the plurality of batteries of said battery pack are positioned at opposite ends of said thermoplastic or metal tubular casing.

12. The massage roller of claim 1 wherein the plurality of batteries are radially displaced from said first axle.

13. The massage roller of claim 1 wherein the plurality of batteries are housed in a plurality of battery supports that are integrally formed with said thermoplastic or metal tubular casing.

14. The massage roller of claim 1 wherein the length is from 12 to 36 inches.

* * * * *